US007673705B2

(12) United States Patent
Gearhart et al.

(10) Patent No.: US 7,673,705 B2
(45) Date of Patent: Mar. 9, 2010

(54) COMPARTMENTALIZED MWD TOOL WITH ISOLATED PRESSURE COMPENSATOR

(75) Inventors: Marvin Gearhart, Fort Worth, TX (US); Daniel E. Milligan, Willow Park, TX (US); Howard Smith, Granbury, TX (US); Dennis L. Naylor, Haslet, TX (US); Michael Redmond, Arlington, TX (US)

(73) Assignee: The Gearhart Companies, Inc., Fort Worth, TX (US)

( * ) Notice: Subject to any disclaimer, the term of this patent is extended or adjusted under 35 U.S.C. 154(b) by 2 days.

(21) Appl. No.: 12/134,709

(22) Filed: Jun. 6, 2008

(65) Prior Publication Data

US 2009/0301780 A1 Dec. 10, 2009

(51) Int. Cl.
*E21B 47/01* (2006.01)

(52) U.S. Cl. ..... 175/40; 175/48; 367/85

(58) Field of Classification Search ..... 166/250.01; 175/40, 48, 57; 73/152.03, 152.04, 152.18, 73/152.19, 152.43; 702/6, 9, 10; 340/855.4, 340/856.3; 367/25, 84, 85; 181/102; 324/324, 324/323

See application file for complete search history.

(56) References Cited

U.S. PATENT DOCUMENTS

| | | | | |
|---|---|---|---|---|
| 4,184,545 | A * | 1/1980 | Claycomb | 166/113 |
| 5,115,415 | A | 5/1992 | Mumby et al. | |
| 5,660,238 | A | 8/1997 | Earl et al. | |
| 6,016,288 | A | 1/2000 | Frith | |
| 6,604,582 | B2 | 8/2003 | Flowers et al. | |
| 6,953,094 | B2 | 10/2005 | Ross et al. | |
| 7,057,524 | B2 | 6/2006 | Innes | |
| 7,145,834 | B1 | 12/2006 | Jeter | |
| 7,180,826 | B2 | 2/2007 | Kusko et al. | |
| 7,190,084 | B2 | 3/2007 | Hall et al. | |
| 7,430,153 | B2 | 9/2008 | Fraser et al. | |
| 2005/0231383 | A1 | 10/2005 | Pratt et al. | |
| 2006/0254819 | A1 | 11/2006 | Moriarty | |

* cited by examiner

*Primary Examiner*—Kenneth Thompson
(74) *Attorney, Agent, or Firm*—John G. Fischer, Esq.; Storm LLP

(57) ABSTRACT

The present invention relates to a measurement-while-drilling (MWD) tool having a pressure compensation system and reservoir segregated from fluid integration with actuator mechanism lubricants. The MWD tool can also be serviced on the rig floor without the need to drain, reseal and charge the compensation system.

10 Claims, 9 Drawing Sheets

COMPARTMENTALIZED MWD TOOL WITH ISOLATED PRESSURE COMPENSATOR

TECHNICAL FIELD OF THE INVENTION

The present invention relates to a measurement-while-drilling tool that is compartmentalized to facilitate rapid field servicing and component replacement without the need to remove the tool from the drilling site for specialized service. In particular, the pressure compensation system and reservoir are segregated from fluid integration with the actuator mechanism's lubricants. The present invention permits disconnection of tool sections adjacent the pressure compensating reservoir without drawing a vacuum for oil filling of those sections. This also provides for the manufacture of a shorter and less expensive tool.

BACKGROUND OF THE INVENTION

In the exploration of oil, gas, and geothermal energy, drilling operations are used to create boreholes, or wells, in the earth. In many locations, it has been found to be advantageous to be able to track the position and direction of the subterranean drill bit during the drilling process. Measurement-while-drilling (MWD) tools have been developed for this purpose.

MWD tools typically have electromechanical accelerometers mounted with their sensitive axis aligned orthogonally to the spin axis and to each other. Micro-electrical-mechanical systems (MEMS) based accelerometers are also available. Tools may also include other sensors for determining properties such as wellbore temperature and azimuthal direction of inclination of the wellbore. For example, gyroscopes or magnetometers may also be included. The sensors are operated on power provided by a rechargeable battery pack located in the tool. Data recorded from the sensors is sent to onboard memory. The data is coded into pulses similar in theory to Morse code. Each MWD system has its own proprietary code.

A pulser located in the MWD tool is provided to generate hydraulic pulses at the MWD tool. The pulses create waves in the fluid mud column that reach the surface, where pressure sensors record them. The recorded pulses are filtered to remove normally occurring extraneous signal noise unrelated to the pulses sent by the MWD tool. The filtered pulses are then decoded to reveal the data recorded by the MWD sensors. The data is then displayed at the surface in a manner useful to the drilling personnel.

Pulses may be generated in a variety of manner, including positive pulse, negative pulse, and combinations thereof. Most conventional MWD units have a pilot valve that actuates a primary pulser. In this manner, a stronger pulse can be sent into the mud column which permits detection and identification apart from system noise and decoding by the surface equipment.

MWD tools are available in retrievable or non-retrievable designs. Retrievable MWD tools can be removed from the drill string at any time. Non-retrievable MWD tools remain in the drill string until the drill string is removed from the wellbore. Upon retrieval, MWD tools frequently require mechanical and electrical service.

Conventional pulser units include solenoid and motor driven varieties. Conventional motor driven pulsers utilize a magnetic coupling to transmit power between the motor and a ball screw assembly. The ball screw assembly actuates a pilot valve which in turn operates the pulser.

Conventional MWD designs have a combined lubrication and pressure compensation system. The system is intended to equalize the internal pressure of the lubrication and compensating reservoir with the external wellbore pressure, while using the compensating fluid for lubrication of the actuator mechanism. A pressure balance rod on which the pilot valve is attached is exposed to both internal and external pressures, and operates better when the internal and external pressures are balanced. Without a balanced system, the motor and actuator must overcome the pressure differential, with energy supplied by the limited batteries source. The reservoir also serves as the lubrication system for the actuator assembly, substantially enclosing the magnetic coupler and ball screw assemblies.

Due to the harsh environment in which survey tools operate, they are carefully sealed to protect the internal components. When motors are used, special seals are required to prevent the oil from leaking past the magnetic couplers into the motor. The lubrication and compensation reservoir is typically vacuum-filled and sealed on a shop bench.

A principal disadvantage of known MWD tools is the susceptibility of pilot valves clogging due to lost circulation material (LCM) becoming trapped between the pilot valve and the seat of the valve. In particular, MWD tools utilizing motors and magnetic couplings are limited in torque to the power of the magnet. Magnetic couplings are known to slip in high torque conditions, including interference caused by LCM, and thus rendering false pulse patterns. Magnetic coupling systems are also relatively long, commonly being up to three feet in length.

A principal disadvantage of the combined lubrication and pressure compensation system of known MWD tools is reliability and serviceability. When direct drive motors are used instead of magnetic couplings, the pressure compensating and lubrication oil must be sealed from the rotating shaft of the motor. The seal against the rotating shaft will have a limited life. The brushes and field coils of the motor will eventually pick-up the metal-iron fines and impurities in the oil, causing the motor to fail. When the motor fails, servicing the motor requires disassembly and drainage of the lubrication and compensation reservoir and, thus, return of the tool to the shop bench for sealing, reassembly and reservoir refilling under vacuum. Conventional MWD tools with lengthy components and integrated lubrication and compensation reservoirs are not, thus, serviceable in the field.

Another principal disadvantage of known MWD tools is the pressure loss associated with the location of the tool within the confines of the internal diameter of drill collars. Pressure is lost due to high flow rates between the exterior of the MWD tool and the drill collar I.D. This pressure is then unavailable to the drill bit. Pressure (or flow rate) to the drill bit is critical to the rate of penetration and life of the drill bit, and is a significant factor on the calculation of the cost per foot of the drilling operation. The larger the diameter of the MWD tool, the greater the system pressure loss will be. Similarly, the longer the MWD tool, the greater the system pressure loss will be.

Another principal disadvantage of known MWD tools is material cost. Due to the high velocity of the fluid between the exterior of the MWD tool and the inside diameter of the drill collars, expensive alloyed materials are required. Typically, the housing of conventional MWD tools is made from beryllium copper or a similarly wear resistant material. As a result, larger MWD tool diameters and longer length tools substantially increase the material cost of the tool.

A principal disadvantage of known MWD tools utilizing motors is that commercially available motors have a significantly larger form factor (profile) than do solenoid systems, thus requiring larger diameter housings and increased material cost. Also, higher-powered commercially available motors capable of extended service are larger in diameter. Additionally, motors are provided with mounting brackets that are external to the circumference of the motor housing. Therefore, increasing the motor power requires increasing the diameter of the tool. Of similar disadvantage, magnetic couplings are relatively lengthy assemblies.

Therefore, there is a further need to develop an MWD tool which can be serviced at the rig floor without draining the lubrication and compensation system, and without requiring shop delivery to reassemble and refill. There is a further need to develop an improved MWD tool having a shorter length to save cost and drilling efficiency. There is also a need to develop an MWD tool having greater reliability obtained from a more powerful motor driven actuator, without the increasing manufacturing and drilling costs associated with increased tool diameter. Lastly, there is a further need to develop a more compact and effective pressure compensation system.

There is also a need to accomplish these goals at a reasonable cost. The harsh drilling environment has prevented efforts to accomplish these goals in the past.

SUMMARY OF THE INVENTION

As referenced herein throughout, the terms "downward," "lower," "bottom," and "below" refer to the direction or portion of a part or assembly located or oriented towards the bottom of the wellbore when being used in a drilling assembly. The terms "upward," "upper," "top," and "above" refer to the direction or portion of a part or assembly located or oriented towards the top of the wellbore when being used in a drilling assembly.

The present invention provides a substantially improved MWD tool. More specifically, the present invention is directed to the pressure balance and actuator assembly portion of the tool which includes a pressure compensation reservoir isolated from the actuator chassis, motor and ball screw assembly.

The MWD tool of the present invention has a lower pulser assembly that is receivable in a landing sub. The lower pulser assembly has an orifice located at its upper end. A screen housing is connected to the upper end of the lower pulser assembly. The screen housing has a plurality of passages through which drilling fluid enters the MWD tool.

A pressure balance chassis is removably connected to the upper end of the screen housing. An actuator chassis is removably connected to the upper end of the pressure balance chassis. A motor-electronics chassis is removably connected to the upper end of the actuator chassis. A hollow pressure barrel is slidably positioned over the motor-electronics chassis, actuator chassis, and pressure balance chassis. The pressure barrel is removably connected to the upper end of the screen housing.

A fluid-filled pressure-compensating reservoir is located in axially sealed relationship within the pressure balance chassis. A pliable bladder circumferentially surrounds the pressure-compensating reservoir. A pressure balance rod extends through the pressure balance chassis, in slideable relationship with the pressure balance chassis.

A piston is formed on the pressure balance rod, and is located within a cylinder bore portion of the pressure balance chassis. The compensating reservoir is in fluid communication with the portion of the cylinder bore that is above the piston. A pilot valve tip is located on the lower end of the pressure balance rod, and positioned for flow restricting alignment with the orifice of the lower pulser. A plurality of venting perforations is located on the pressure barrel in alignment with the bladder, exposing the bladder to the pressure of the drilling fluid outside of the MWD tool. Drilling fluid pressure acting on the pilot valve tip is thus compensated by fluid pressure in the compensating reservoir acting against the piston.

Also, upon disconnection of the motor-electronics chassis from the actuator chassis for service of the tool, the fluid in the compensating reservoir remains axially sealed within the pressure balance chassis.

In another preferred embodiment, the cross-sectional area of the cylinder bore portion of the pressure balance chassis is substantially equal to the sum of the cross-sectional area of the pilot valve tip plus the cross-sectional area of the pressure balance rod.

In another preferred embodiment, a case-hardened gear train housing is provided that has a circular external diameter that is approximately equal to the external diameter of the motor housing. Electrical connections are rerouted through the rear plate of the motor. The actuator chassis has a portal for receiving the gear train and longitudinal slits at the portal. Fasteners located in holes through the slits permit slight compression of the chassis to secure the gear train and motor in place.

A principal advantage of the present invention is that it provides a more compact and effective pressure compensation system. Another advantage of the present invention is that it provides segregation between actuator lubricants and pressure compensating fluids, permitting optimized selection of each.

Another advantage of the present invention is that it provides enhanced serviceability on the rig floor, by permitting disassembly without draining the lubrication system or the pressure compensating system, and thus does not require return of the tool to the shop bench for reservoir refilling and sealing.

A principal advantage of the present invention is that it provides an MWD tool with increased actuator power, which is less susceptible to clogging due to lost circulation material (LCM) becoming trapped between the pilot valve and the seat of the valve. Another advantage of the present invention is that it provides an MWD tool having a shortened coupling system.

Another advantage of the present invention is that it provides an MWD tool with increased actuator power within a smaller diameter and shorter length, thus reducing the pressure loss to the drill bit. Another advantage of the present invention is that it provides an MWD tool with a lower material cost.

As referred to hereinabove and throughout, the "present invention" refers to one or more embodiments of the present invention, which may or may not be claimed, and such references are not intended to limit the language of the claims, or to be used to construe the claims in a limiting manner.

BRIEF DESCRIPTION OF THE DRAWINGS

The objects and features of the invention will become more readily understood from the following detailed description and appended claims when read in conjunction with the accompanying drawings in which like numerals represent like elements.

The drawings constitute a part of this specification and include exemplary embodiments to the invention, which may be embodied in various forms. It is to be understood that in some instances various aspects of the invention may be shown exaggerated or enlarged to facilitate an understanding of the invention.

DETAILED DESCRIPTION OF THE PREFERRED EMBODIMENTS

The following description is presented to enable any person skilled in the art to make and use the invention, and is provided in the context of a particular application and its requirements. Various modifications to the disclosed embodiments will be readily apparent to those skilled in the art, and the general principles defined herein may be applied to other embodiments and applications without departing from the spirit and scope of the present invention. Thus, the present invention is not intended to be limited to the embodiments shown, but is to be accorded the widest scope consistent with the principles and features disclosed herein.

Figure 1:
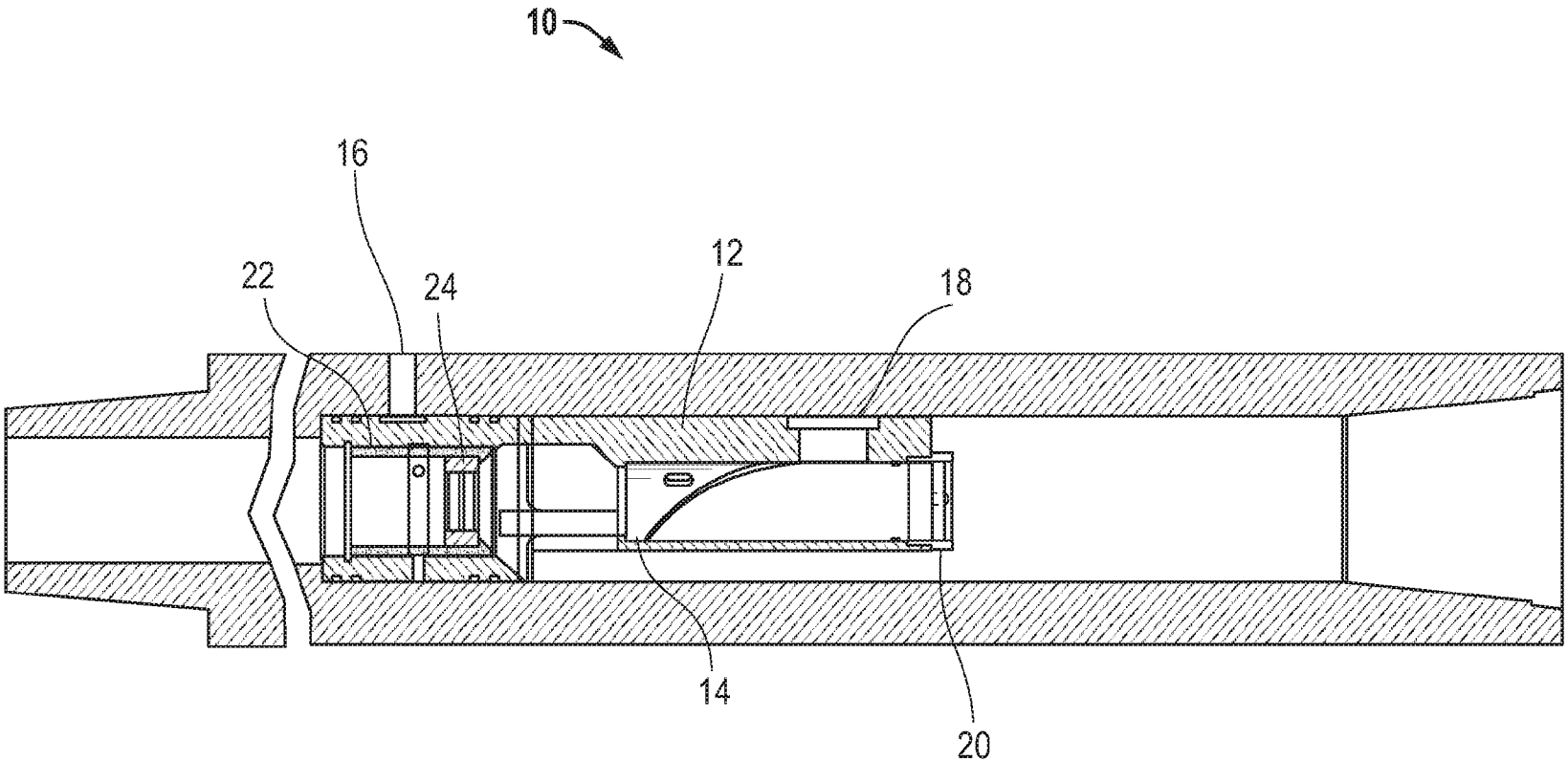
FIG. 1 is a side sectional view of a landing sub of the type that may be used in conjunction with the preferred embodiments of the present invention.

FIG. 1 is a side sectional view of a landing sub 10. A landing sub 10 is provided for location in the collar section of a drill string. Landing sub 10 is positioned in the drill string above the drill bit and mud motor, if one is used. A muleshoe 12 having a lower helix 14 is located internal to landing sub 10 for receiving MWD Tool 1. Muleshoe 12 is secured in position within landing sub 10 by a plurality of set screws 16. A locator key 18 projects radially inward for lateral angular positioning of MWD Tool 1 in muleshoe 12. A wear cuff 20 is located at the top of muleshoe 12 for limiting the insertion of MWD Tool 1 in landing sub 10 and for absorbing vibration and impact during operation of MWD Tool 1. An orifice sleeve 22 is located at the bottom of muleshoe 12. A carbide orifice 24 is located inside orifice sleeve 22.

Figure 2:
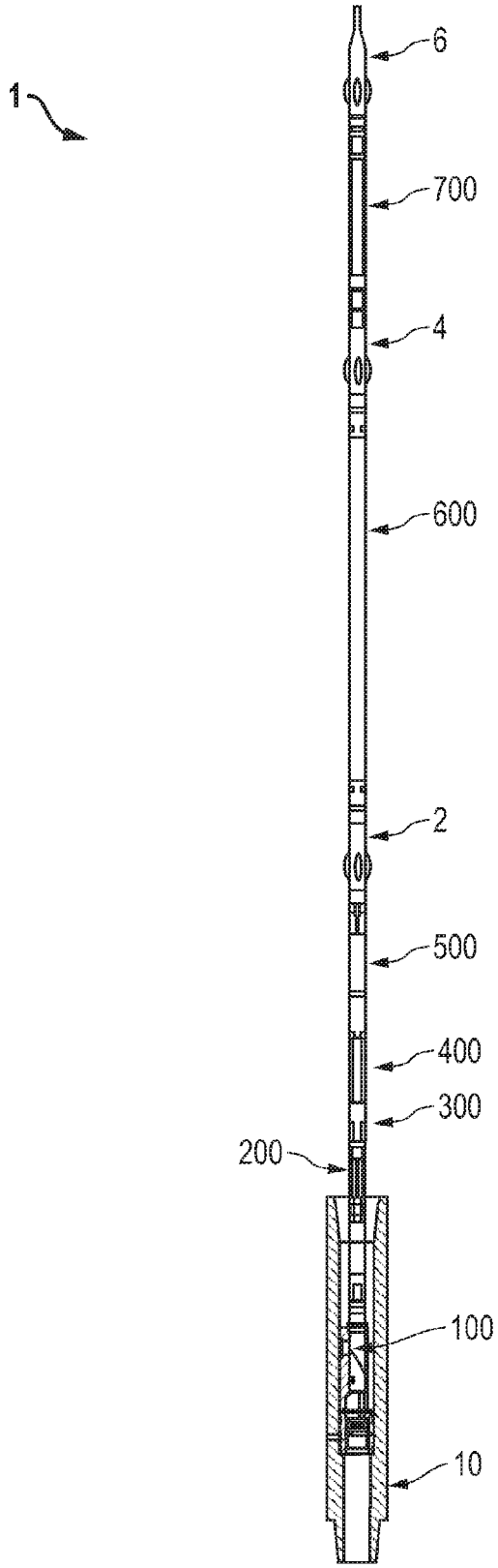
FIG. 2 is a partially-sectioned side view of MWD Tool 1, illustrated in accordance with a preferred embodiment of the present invention.

FIG. 2 is a partially sectioned side view of MWD Tool 1, illustrating MWD Tool 1 engaged in landing sub 10. MWD Tool 1 has an upper end and a lower end, the lower end being disposed closest to the drill bit. A lower pulser assembly 100 comprises the lower end of MWD Tool 1. A screen housing 200 is attached above lower pulser assembly 100. A pressure balance assembly 300 and actuator assembly 400 are attached above lower pulser assembly 100. A motor and electronics assembly 500 is attached above actuator assembly 400. A lower centralizer 2 is typically attached above motor and electronics assembly 500. A battery barrel 600 is attached above motor and electronics assembly 500. An upper centralizer 4 is typically attached above battery barrel 600. A Navigation Master Assembly 700 is attached above upper centralizer 4. A lifting connection 6, such as a rope socket, is typically attached above Navigation Master Assembly 700.

Figure 3:
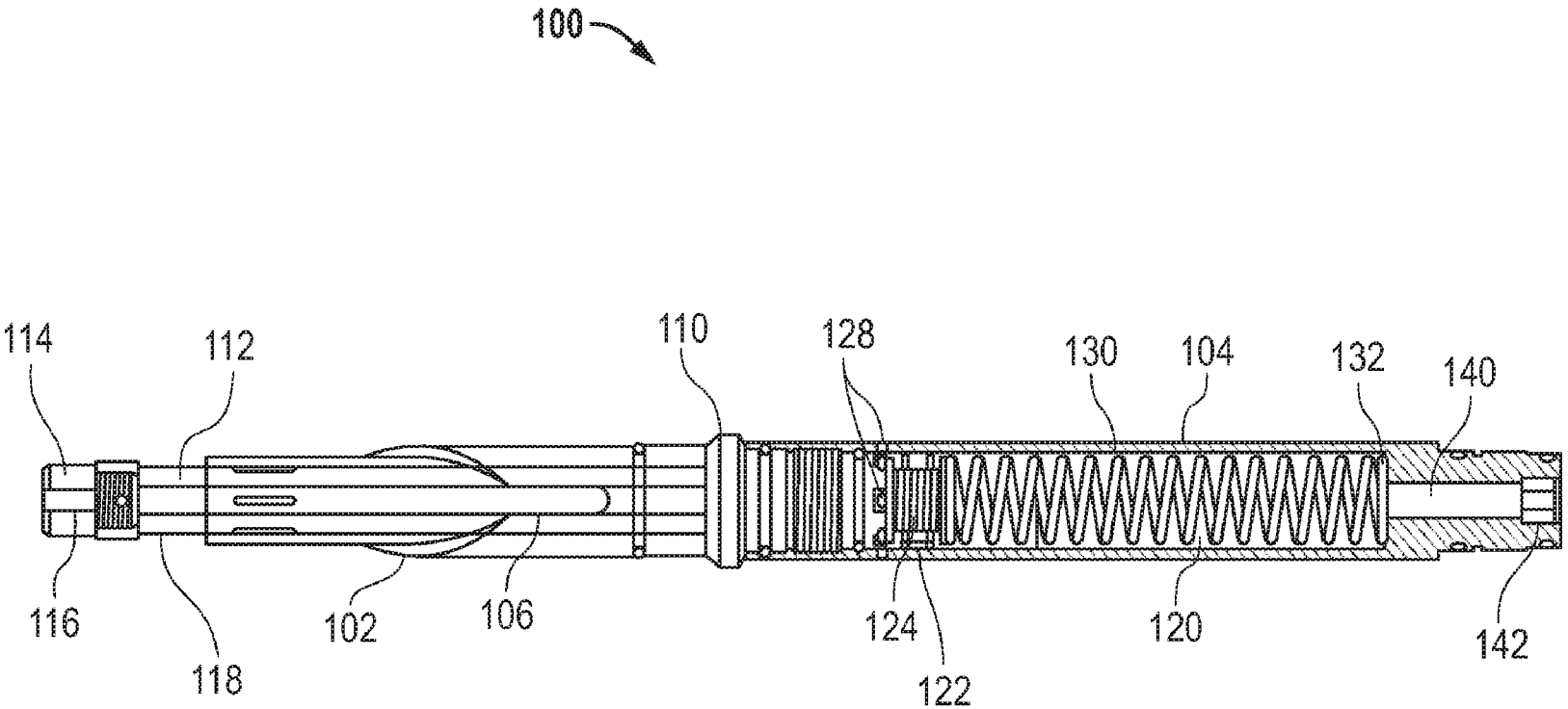
FIG. 3 is a side sectional view of the lower pulser assembly of the MWD Tool 1, illustrated in accordance with a preferred embodiment of the present invention.

FIG. 3 is a side sectional view of lower pulser assembly 100. Lower pulser assembly 100 is comprised of a helix 102 connected to a hollow hydro chassis 104, with various internal components communicating between them. Helix 102 fits in mechanical engagement with lower helix 14 on muleshoe 12 in landing sub 10. Helix 102 has a hollow center. A longitudinal slot 106 is provided on the exterior surface of helix 102 for vertical engagement with locator key 18. The upper end of helix 102 is thread connected to hollow hydro chassis 104.

A wear ring 110 is located on the external surface of helix 102 at the connection of helix 102 to hydro chassis 104. Wear ring 110 engages wear cuff 20 when seating MWD Tool 1 inside landing sub 10. A hollow push rod 112 slidably extends through the center of helix 102 and beyond the top and bottom ends of helix 102. A poppet 114 is attached to the lower end of push rod 112. Poppet 114 is normally made of a hard, wear resistant material, such as carbide. A hollow orifice 116 is formed through the center of poppet 114 to allow drilling fluid to pass through.

A plurality of longitudinal surface flats 118 are located on the lower end of push rod 112, above poppet 114, to provide reduced friction passage of mud when push rod 112 slides through helix 102. The opposite, upper end of push rod 112 extends into a cylinder chamber 120 inside hydro chassis 104. A piston 122 is located in cylinder chamber 120 and thread connected to the upper end of push rod 112. A piston orifice 124 is secured inside piston 122. Piston orifice 124 allows drilling fluid a continuous flow path through to the interior of push rod 112 and piston 122. In a preferred embodiment, a plurality of small holes 128 is circumferentially located in hydro chassis 104 above the position of piston 122.

A compression spring 130 is located inside chamber 120 of hydro chassis 104. Spring 130 is partially compressed between the end of piston 122 and a circular ledge 132 at the upper end of chamber 120. In this manner, spring 130 urges piston 122 downward, which in turn urges poppet 114 to close in relation to orifice 24, restricting flow around poppet 114.

A passage 140 is provided between chamber 120 and the upper end of hydro chassis 104. A valve seat 142 is located in the end of the passage. The upper end of hydro chassis 104 is threaded for connection to pressure balance assembly 300 and actuator assembly 400. Valve seat 142 receives a pilot valve 332 of pressure balance assembly 300 and actuator assembly 400.

Figure 4:
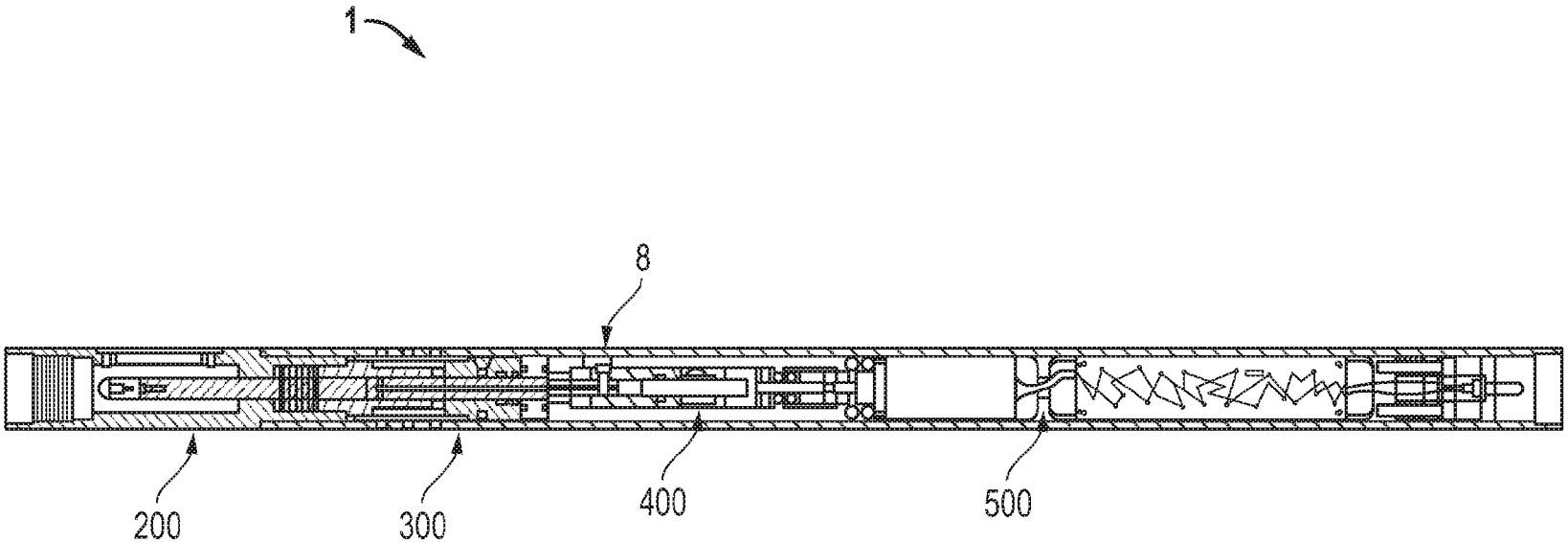
FIG. 4 is a cross-section of a portion of the MWD Tool 1, illustrating a screen housing connected to a pressure balance assembly, which is connected to an actuator assembly, which is connected to a motor-electronics assembly in accordance with a preferred embodiment of the present invention.

FIG. 4 is a cross-section of a portion of the MWD Tool 1, illustrating screen housing 200 connected to pressure balance assembly 300, which is connected to actuator assembly 400, which is connected to motor-electronics assembly 500. Screen housing 200 is thread connected to the upper end of hydro chassis 104. When connected, valve seat 142 of hydro chassis 104 is located inside the hollow center of screen housing 200. A perforated mud screen 202 is attached to screen housing 200 to permit the flow of drilling fluid into screen housing 200.

Pressure barrel 8 is thread connected to the upper end of screen housing 200. In the preferred embodiment illustrated, three separable chassis are connected in series to support the working components inside pressure barrel 8. A pressure balance chassis 310 (FIG. 5) is located at the lower end of pressure barrel 8. An actuator chassis 410 (FIG. 6) is located in the middle portion of pressure barrel 8. A motor-electronics chassis 510 (FIG. 10) is located at the upper end of pressure barrel 8.

Removal of pressure barrel 8 provides access to pressure balance chassis 310, actuator chassis 410, and motor-electronics chassis 510. Pressure barrel 8 can be removed without loss of oil from a pressure compensation reservoir 328.

Figure 5:
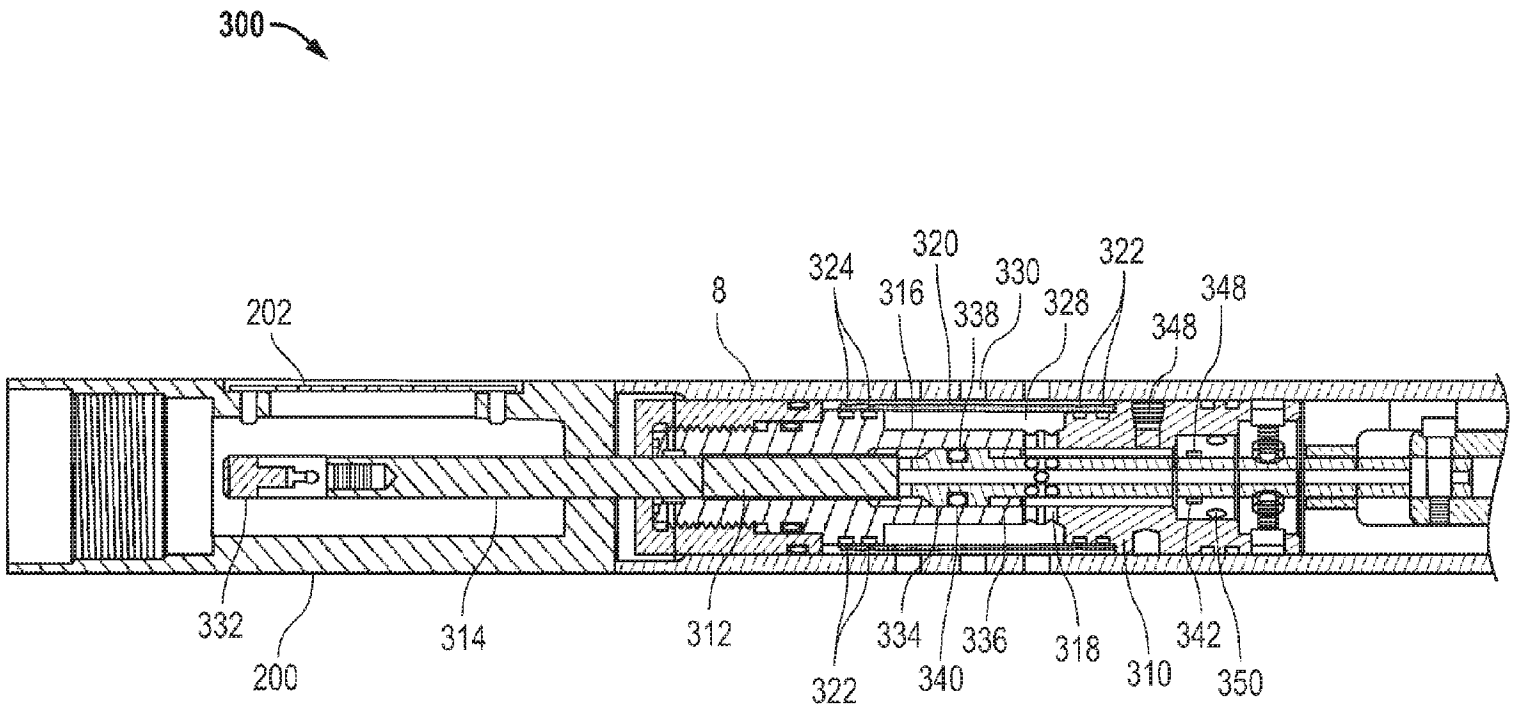
FIG. 5 is a cross-section of a portion of the MWD Tool 1, illustrating a pressure balance assembly connected between a screen housing and an actuator assembly in accordance with a preferred embodiment of the present invention.

FIG. 5 is a cross-section of a portion of MWD Tool 1, illustrating pressure balance assembly 300 connected between screen housing 200 and actuator assembly 400. To support the working components, a pressure balance chassis 310 is connected between screen housing 200 and an actuator chassis 410. In the preferred embodiment illustrated in this view, the lower end of pressure balance chassis 310 is thread connected inside the upper end screen housing 200, which is attached inside the lower end of pressure barrel 8. Pressure balance chassis 310 is generally tubular, but otherwise has a relatively complex profile. A smooth interior bore 312 is provided through pressure balance chassis 310 for receiving a pressure balance rod 314 in sliding relation. Pressure balance rod 314 has a pilot valve 332 connected at its lower end which operates in opening and closing relationship with valve seat 142 of hydro chassis 104.

Pressure balance chassis 310 has a central relief portion 316 with a reduced external diameter. A pliable bladder 320 surrounds central relief 316. Bladder 320 is circumferentially secured and sealed to the external surface of pressure balance chassis 310 on both sides of central relief 316 in a fluid-tight manner, by clamps 322, which may be wrapped buss wire, or another clamping device. Circumferential grooves 324 may be provided on pressure balance chassis 310 for receiving clamps 322. The volume between central relief 316 and bladder 320 provides a compact and uniquely isolated pressure-compensating reservoir 328. Venting perforations 330 are provided through pressure barrel 8 above bladder 320 to facilitate equalization of fluid pressure between the exterior of pressure barrel 8 and pressure-compensating reservoir 328.

The central portion of pressure balance rod 314 includes a circumferentially raised piston 334. Piston 334 is located inside an enlarged cylinder portion 336 of interior bore 312 of pressure balance chassis 310. Reservoir fluid passages 318 provide fluid communication of compensating fluid between pressure compensating reservoir 328 and cylinder 336. One or more circumferential grooves 338 in piston 334 has a piston seal 340 located therein, forming a seal between piston 334 and cylinder 336. Piston seal 340 prevents passage of compensating fluid in cylinder 336 beyond piston 334.

Figure 7:
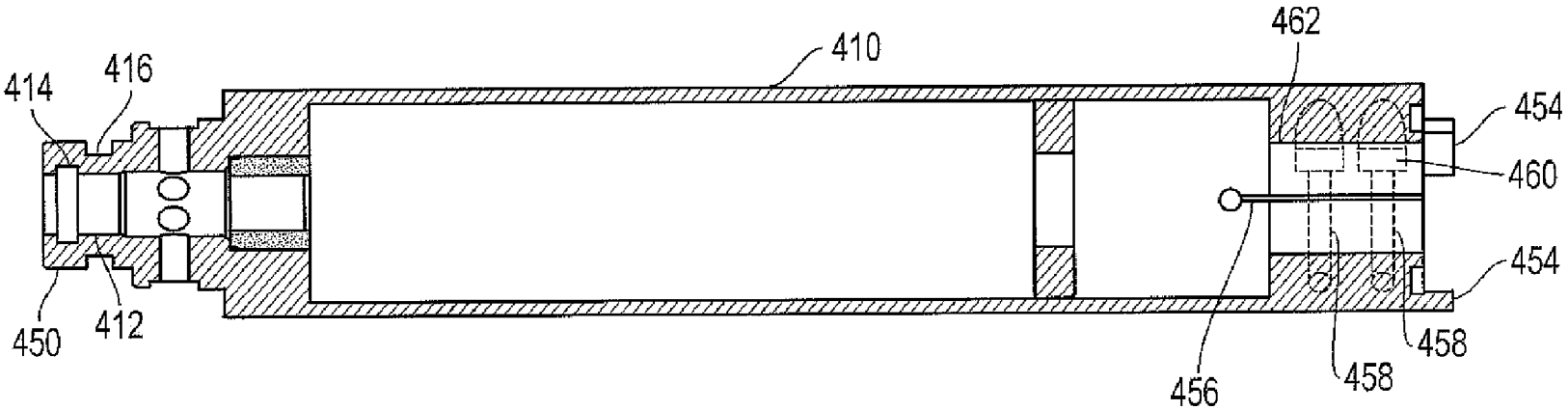
FIG. 7 is a side view of the actuator chassis of FIG. 6, illustrated rotated 90°.

In a preferred embodiment, pressure balance chassis 310 has a receptacle 350 on its upper end. As best seen in FIG. 7, a cylindrical bushing 450 is formed on the lower end of actuator chassis 410. When actuator chassis 410 is connected to pressure balance chassis 310, bushing 450 is received in receptacle 350 in close tolerance engagement, forming the upper end of cylinder 336.

Figure 6:
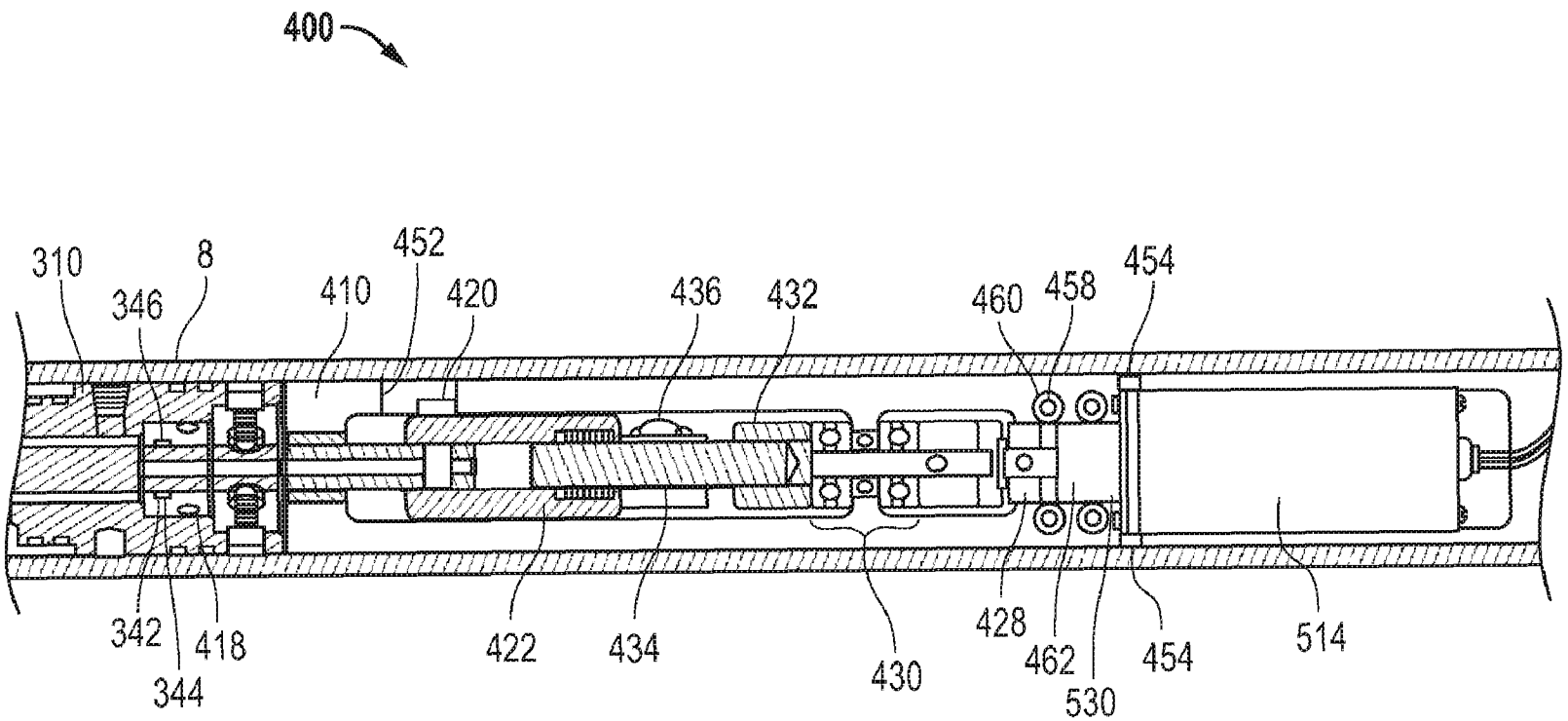
FIG. 6 is a side view of the actuator assembly connected between a pressure balance assembly and a motor-electronics assembly, illustrated in accordance with a preferred embodiment of the present invention.

FIG. 6 is a side view of actuator assembly 400 connected between pressure balance assembly 300 and motor and electronics assembly 500, illustrated in accordance with a preferred embodiment of the present invention. FIG. 7 is a side view of actuator chassis 410 of FIG. 6, illustrated as rotated 90°.

As seen in these views, actuator chassis 410 has a central bore 412 for receiving pressure balance rod 314 in sliding relation. A seal groove 414 is formed in central bore 412 within bushing 450 for location of one of more rod seals 342. In a more preferred embodiment, an external seal groove 416 is provided on the exterior of bushing 450 for location of one or more chassis seals 418 for sealing between bushing 450 of actuator chassis 410 and receptacle 350 of pressure balance chassis 310. In this embodiment, rod seal 342 and chassis seal 418 provide the upper end seals of the pressure compensating system.

One or more rod seals 342 surrounds pressure balance rod 314 to prevent passage of compensating fluid above or beyond rod seal 342. In the preferred embodiment illustrated, one or more circumferential grooves 346 on actuator chassis 410 has a rod seal 342 located therein, forming the seal between the upper end of pressure balance rod 314 and pressure balance chassis 310. In a more preferred embodiment, a secondary rod seal 344 is provided adjacent to rod seal 342 to enhance sealing of the pressure-compensating fluid.

In the above described configuration, piston 334 operates to move pressure balance rod 314 in response to pressure changes at the surface of bladder 320 from within the well bore. Unique to the present invention, the exposed cross-sectional area of cylinder portion 336 is designed to be substantially equal to the sum of cross-sectional area of pilot valve 332 plus the cross-sectional area of pressure balance rod 314. The result is a force-balanced movement of pressure balance rod 314 in either direction, in response to pressure changes acting on substantially equal areas. In this manner, an isolated and minimized volume pressure-compensating reservoir 328 can be used and still ensure downhole hydrostatic pressure does not impair or impede the ability of the actuator assembly 410 to operate pilot valve 332.

A pipe plug 348 in pressure balance chassis 310 provides access for fluid filling of pressure-compensating reservoir 328. The configuration detailed above isolates the pressure compensation fluid from other moving parts within the actuator assembly 400. Importantly, this permits utilization of lubricants that may be less suitable in performance as pressure compensating fluids, and vice-versa. In particular, grease has been shown to be a superior lubricant for the actuator ball screw, but is inferior in performance as a compensating fluid.

The above-described design further permits service to most component portions of MWD Tool 1 without the need to return the tool to the shop to replace the compensating fluid. Simple bench service of the tool can be performed without the loss of the critical compensating fluid. This is increasingly useful as newer tools are beginning to have reconfiguration options related to the well conditions and required information.

Actuator chassis 410 is located centrally inside pressure balance vent barrel 8 between pressure balance chassis 310 and motor-electronics chassis 510 and secured to each. Actuator chassis 410 has a central bore 412 for receiving pressure balance rod 314 in sliding relation. A shoulder bolt 420 connects the upper end of pressure balance rod 314 to a ball screw nut connector 422 on actuator chassis 410. Axial movement of nut connector 422 results in movement of pressure balance rod 314 and opening and closing of pilot valve 332 in relation to valve seat 142 of hydro chassis 104.

As assembled, a gear train 530 of a motor 514 extends into the interior of actuator chassis 410. A ball screw 434 is operatively connected at one end to gear train 530. In the preferred embodiment, an Oldham connector 428 is connected to motor gear train 530. A thrust bearing assembly 430 and thrust bearing shaft 432 are attached to Oldham connector 428 at one end. At its opposite lower end, ball screw 434 is thread connected to a ball screw nut 436 and nut connector 422. Shoulder bolt 420 limits the longitudinal travel of nut connector 422 within a longitudinal slot 452. Rotation of nut connector 422 is also prohibited.

Operation of motor 514 moves nut connector 422 and pressure balance rod 314 longitudinally to open and close valve 332 in relation to valve seat 142. In the normal, non-actuated position, pilot valve 332 is closed, causing main poppet 114 to remain open. In the actuated position, pilot valve 332 is opened, causing main poppet 114 to close. Closing poppet 114 creates a marked restriction in the total flow area causing a pressure spike, or pulse, in the supply side of the fluid system, which is received by pressure monitoring equipment at the surface of the well.

Figure 10:
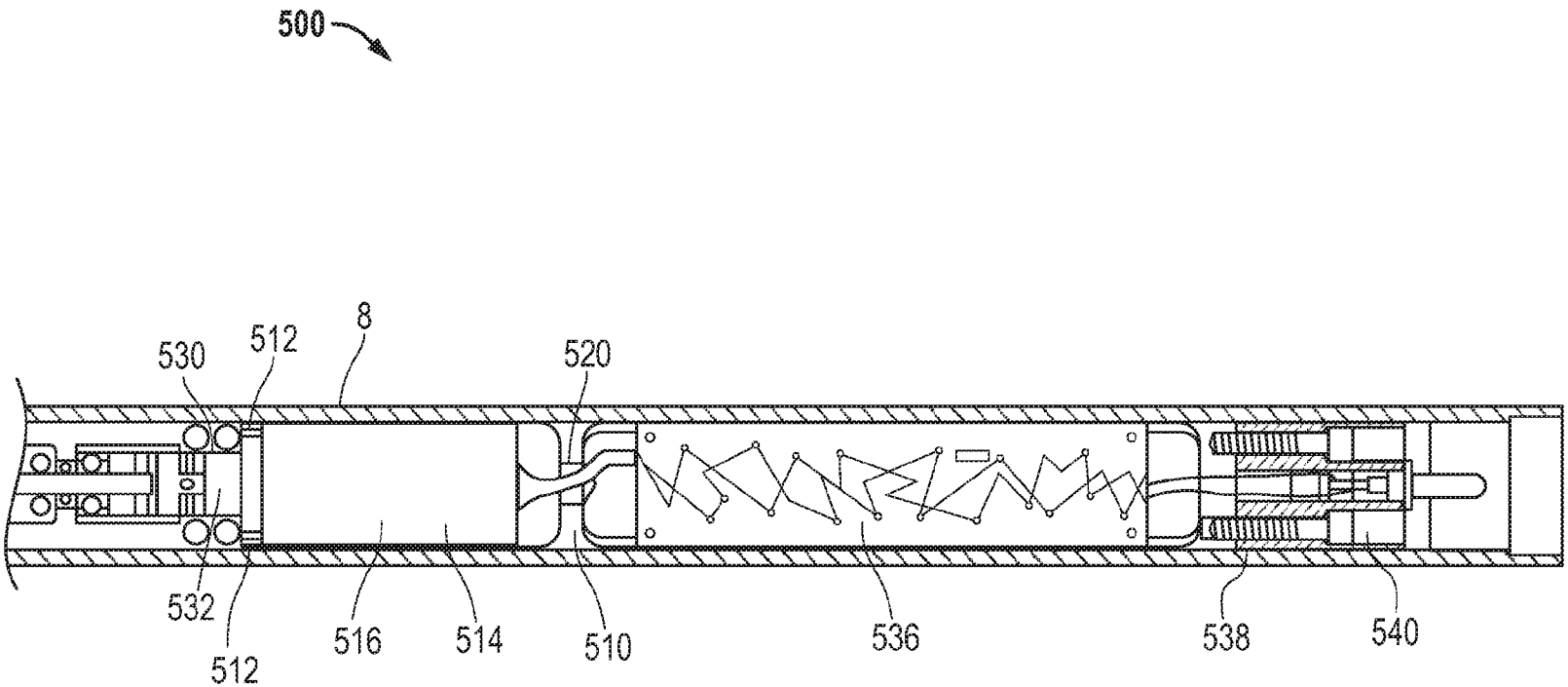
FIG. 10 is a side sectional view of a motor and electronics assembly illustrated in accordance with a preferred embodiment of the present invention.

FIG. 10 is a side sectional view of motor and electronics assembly 500 illustrated in accordance with a preferred embodiment of the present invention. Motor-electronics chassis 510 supports motor 514, gear train 530, and a motor electronics circuit board 536. A compressible rubber snubber 538 internally secures motor-electronics chassis 510. The engagement of motor-electronics chassis 510 to actuator chassis 410 and the design on gear train 530 are unique to the present invention.

Figure 8:
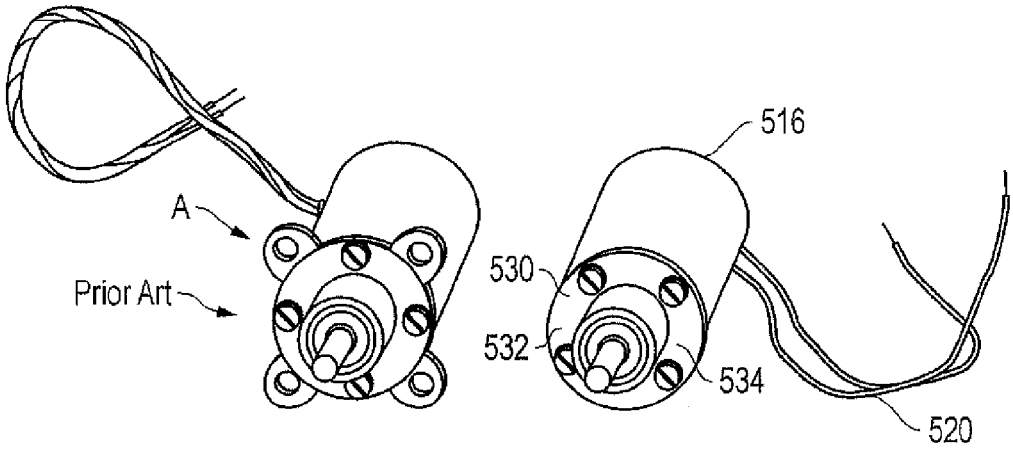
FIG. 8 is an isometric view comparing the prior art motor and gear train housing with the motor and gear train housing of a preferred embodiment of the present invention.

FIG. 8 is an isometric view comparing the prior art motor and gear train housing with motor 514 and gear train housing 532 of the preferred embodiment of the present invention. As seen in FIG. 8, the prior art gear train housings have radially extending flanges A for axial attachment to a structural component of the MWD Tool 1.

Figure 9:
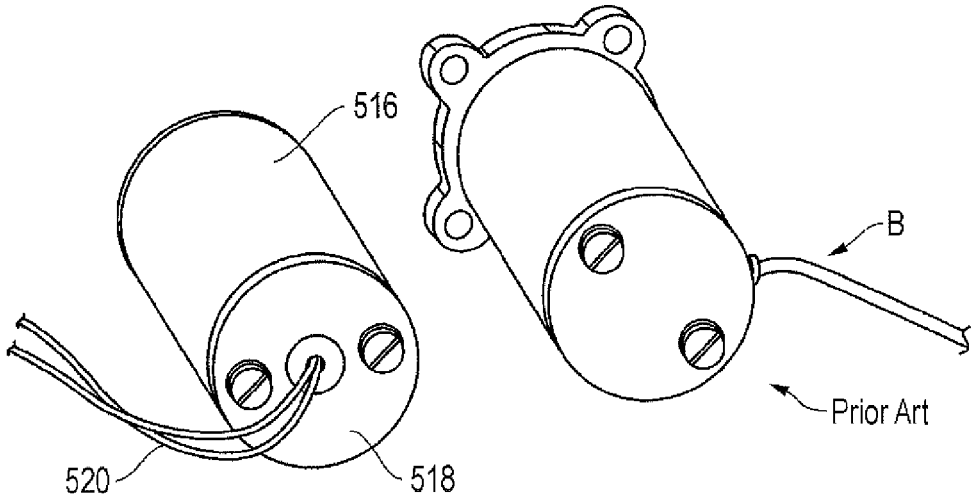
FIG. 9 is an isometric view comparing the prior art motor, rear plate and electric connections with the motor, rear plate and electric connections of a preferred embodiment of the present invention.

FIG. 9 is an isometric view comparing the prior art motor, rear plate and electric connections with the motor, rear plate and electric connections of a preferred embodiment of the present invention. As seen in FIG. 9, the prior art motors have the electrical wiring extending radially outward from the upper end of the motor.

The present invention incorporates a higher speed motor 514 than is conventionally used, for the purpose of increasing the reliability of MWD Tool 1. To accommodate the preferred motor having sufficient speed and power without increasing the diameter of MWD Tool 1, to match the increased size of motor 514, it was necessary to modify motor 514 and gear train 530. Additionally, to provide a modular MWD Tool 1 that can be separated for servicing at motor 514 without draining pressure-compensating reservoir 328, gear train 530 and motor 514 are modified.

As seen in FIG. 8, a new gear train 530 has been designed without connection ears or other radially extending features. In the preferred embodiment, a housing 532 of gear train 530 has a circular external diameter approximately equally to (= or <0.05 larger than) the external diameter of motor housing 516. In the preferred embodiment, gear train housing 532 is case hardened. A small radius 534 is provided as shown to remove the stress riser and prevent crack initiation when compressive forces are applied. As seen in FIG. 9, motor housing 516 and a rear plate 518 of motor 514 are modified to have electrical connections 520 extending directly rearward through rear plate 518, rather than radially outward through motor housing 516.

Referring to FIG. 7 and FIG. 10, tabs 454 extend axially upward from the upper end of actuator chassis 410. Tabs 512 extend downward from the lower end of motor-electronics chassis 510. Tabs 454 and 512 engage complementary slots for aligned engagement of actuator chassis 410 and motor-electronics chassis 510, and preventing relative rotation between actuator chassis 410 and motor-electronics chassis 510.

As seen in FIG. 7, a pair of diametrically opposed slits 456 extends longitudinally downward from the upper end of actuator chassis 410. A pair of threaded fastener holes 458 intersects each slit in perpendicular relation. Threaded fasteners 460 are located in holes 458. The upper end of actuator chassis 410 has a portal 462 located internally of fastener holes 458. As seen in FIG. 10, when motor-electronics chassis 510 is attached to actuator chassis 410, portal 462 receives gear train 530 and motor 514 is received beneath tabs 454 and 512.

The case-hardened housing 532 of gear train 530 and the addition of radius 534 provide a gear train housing 532 that can be compressively secured in portal 462 by tightening threaded fasteners 460 on actuator chassis 410. Compression of longitudinal slits 456 by fasteners 460 secures gear train 530 in portal 462 of actuator chassis 410. This provides a novel method of removably securing motor 514 in place that removably accommodates the larger motor 514 and provides convenient serviceability.

A lower centralizer 2 is typically attached above motor and electronics assembly 500 to centralize the lower portion of MWD Tool 1 in the drill string. A battery barrel 600 is attached above motor and electronics assembly 500. Battery assembly 600 provides the power needed to operate MWD Tool 1. An upper centralizer 4 is typically attached above battery barrel 600 to centralize the upper portion of MWD Tool 1 in the drill string. A Navigation Master Assembly 700 is attached above upper centralizer 4, and contains sensors to take the required directional and inclination measurements. A lifting connection 6, such as a rope socket, is typically attached above Navigation Master Assembly 700 to permit retrieval of MWD Tool 1.

OPERATION OF THE INVENTION

During operation, the drilling fluid has two primary flow paths controlled by the presence and operation of MWD Tool 1. A first flow path is through the interior of MWD Tool 1, and has an interior flow rate $Q_I$. A second flow path is around the exterior of MWD Tool 1, and has an exterior flow rate $Q_E$. Generally:

$$Q_I+Q_E=Q_T$$

where $Q_T$ is the total flow rate of the drilling fluid system. Interior flow rate $Q_I$ and exterior flow rate $Q_E$ vary in accordance with the operation of actuator assembly 400. Operation of actuator assembly 400 alters the internal and exterior flow paths, which changes the flow rates of each as the drilling fluid seeks the path of least resistance. Designating the sub-symbol '0' to indicate actuator assembly 400 at rest, and designating sub-symbol '1' to indicate actuation of actuator assembly 400, the flow rate equation above can be expended as follows:

$$Q_{I(0)}+Q_{E(0)}=Q_T$$

$$Q_{I(1)}+Q_{E(1)}=Q_T$$

Therefore:

$$Q_{I(0)}+Q_{E(0)}=Q_{I(1)}+Q_{E(1)}$$

In summary, in the normal, non-actuated position, pilot valve 332 is closed, causing main poppet 114 to remain open. In the actuated position, pilot valve 332 is opened, causing main poppet 114 to close. Closing poppet 114 creates a marked restriction in the total flow area, which causes a pressure spike, or pulse, in the supply side of the fluid system. Pressure monitoring equipment at the surface of the well senses and records the pressure spikes. System software decodes the sequence of pressure spikes to obtain well direction data.

Referring now to the operation in greater detail, in the normal, non-actuated position, pilot valve 332 is closed and flow through the interior flow path is 'essentially' zero. This necessarily maximizes flow through the exterior path. Thus:

$$Q_{I(0)} \approx 0$$

Therefore:

$$Q_{E(0)} = Q_{I(1)} + Q_{E(1)}$$

The entrance of the interior flow path is mud screen 202. However, since pilot valve 332 closing with valve seat 142 blocks flow past valve seat 142, the drilling fluid simply flows over mud screen 202, bypassing the entrance to the interior flow path. Thus the entire flow rate $Q_T$ generated by the pumps at the surface is directed to the exterior flow path at flow rate $Q_{E(0)}$.

Without flow through passage 140, and with the entire system flow $Q_T$ directed externally, a low-pressure zone is created in chamber 120 of hydro chassis 104. The low pressure of chamber 120 and high flow rate between poppet 114 and orifice 24 forces poppet 114 and push rod 112 upwards, overcoming the force of spring 130. Fluid in chamber 120 exits poppet 114 as piston 122 moves upward.

With poppet 114 open in relation to orifice 24, the drilling fluid has a direct path over MWD Tool 1 and a large area of passage. Drilling fluid flows along the exterior of MWD Tool 1 and into the interior of the drill string. When this drilling fluid enters landing sub 10, it flows by muleshoe 12 between poppet 114 and orifice 24, and continues downward through the interior of the drill collars below. Thus, when the interior flow path is closed, the exterior flow path is largely unrestricted, and pressure loss traveling past MWD Tool 1 is lowest in the non-actuated position.

Pilot valve 332 is opened when retracted from valve seat 142. When actuator assembly 400 operates (opens) pilot valve 332, main poppet 114 closes. When pilot valve 332 is opened, drilling fluid flows through mud screen 202 into screen housing 200. Inside screen housing 200, the drilling fluid continues past valve 332 and through valve seat 142 and into the hollow interior of hydro chassis 104. The drilling fluid asserts downward pressure on piston 122, assisted by the force of spring 130, forcing piston 122 downward and closing poppet 114. The drilling fluid continues through the restricted interior space of piston 122, piston orifice 124 and the interior of push rod 112. The drilling fluid then exits through the end of poppet 114, and finally exits MWD Tool 1 and continues downward through the interior of the drill collars below.

At the same time, drilling fluid flows at a significantly reduced rate along the external fluid path along the exterior of MWD Tool 1, past poppet 114 and into the unrestricted interior of the remaining drill string. This is possible because poppet 114 does not fully engage orifice 24, leaving a restricted passage between them. When the drilling fluid enters landing sub 10, it flows by muleshoe 12 between poppet 114 and orifice 24, and continues downward through the interior of the drill collars below. Since the external flow rate $Q_{E(1)}$ is less than the non-actuated external flow rate $Q_{E(0)}$ by the amount of the internal flow rate $Q_{I(1)}$, there is now insufficient fluid pressure to force poppet 114 upwards against spring 130 to separate poppet 114 from orifice 24.

Referring to FIG. 5, the configuration detailed above isolates the pressure compensation fluid from other moving parts within the actuator assembly 400, including motor 514, protecting motor 514 from premature failure. Importantly, this permits utilization of lubricants that may be less suitable in performance as pressure compensating fluids, and vice-versa. In particular, grease has been shown to be a superior lubricant for the actuator ball screw, but is inferior in performance as a compensating fluid. Similarly, oils that maintain constant viscosity over the operating temperature range of MWD Tool 1 are superior pressure-compensating fluids, but may be inferior to certain greases, such as a ball screw or thrust bearing lubricant.

Referring to FIG. 6, isolated pressure-compensating reservoir 328 performs in conjunction with motor 514 retention system of the present invention. Upon disconnection of motor-electronics chassis 510 from actuator chassis 410 for service of motor 514 or gear train 530, the fluid in pressure-compensating reservoir 328 remains axially sealed within pressure balance chassis 310.

Still referring to FIG. 6, the design of gear train housing 532 and motor 514 permit the use of the largest diameter motor 514 with the confines of the internal diameter of pressure barrel 8. This is achieved by providing gear train housing 532 with a circular external diameter approximately equally to (= or <0.05 larger than) the external diameter of motor housing 516. Compression of longitudinal slits 456 by fasteners 460 secures gear train 530 in portal 462 of actuator chassis 410. This configuration further permits removal of motor 514 and gear train 530 from actuator chassis 410 for servicing, without disconnection of an axially aligned fastener, and without draining the pressure-compensating fluid from the pressure-compensating reservoir 328.

One result of the design described is that it is significantly shorter than prior art designs, and is smaller in diameter than conventional designs using a motor having the same performance characteristics. This reduces the material cost of MWD Tool 1. An additional benefit is that the shorter length and smaller diameter reduce the drilling fluid pressure loss through MWD Tool 1, providing more hydraulic horsepower to the jet nozzles of the drill bit.

It will be readily apparent to those skilled in the art that the general principles defined herein may be applied to other embodiments and applications without departing from the spirit and scope of the present invention.

Having thus described the present invention by reference to certain of its preferred embodiments, it is noted that the embodiments disclosed are illustrative rather than limiting in nature and that a wide range of variations, modifications, changes, and substitutions are contemplated in the foregoing disclosure and, in some instances, some features of the present invention may be employed without a corresponding use of the other features. Many such variations and modifications may be considered desirable by those skilled in the art based upon a review of the foregoing description of preferred embodiments. Accordingly, it is appropriate that the appended claims be construed broadly and in a manner consistent with the scope of the invention.

The invention claimed is:

1. An isolated pressure compensation system for a Measurement-While-Drilling Tool, comprising:

a pressure balance chassis;

a circumferential relief on the exterior surface of the pressure balance chassis;

a pliable cylindrical bladder circumferentially surrounding the relief, and forming a pressure compensating reservoir;

a pair of clamps, circumferentially sealing the bladder to the pressure balance chassis above and below the pressure compensating reservoir;

an interior bore extending through the center of the pressure balance chassis;

a pressure balance rod slidably located in the interior bore;

an enlarged cylinder portion formed on the interior bore;

a fluid passage between the reservoir and the cylinder portion;

a piston formed on the pressure balance rod, the piston being axially slidable within the cylinder portion of the pressure balance chassis, and being located interior of the pressure compensating reservoir;

a piston seal located on the piston, providing a fluid seal between the piston and the cylinder bore;

an actuator chassis connected to the pressure balance chassis, forming the upper end of the cylinder portion;

a motor-electronics chassis connected to the upper end of the actuator chassis;

a rod seal, providing a fluid seal between the pressure balance rod and the actuator chassis;

the bladder being exposed to drilling fluid external to the MWD Tool;

wherein drilling fluid pressure acting on the bladder is transferred to a fluid pressure acting on the piston; and, wherein upon disconnection of the motor-electronics chassis from the actuator chassis, the fluid in the compensating reservoir remains sealed.

2. An isolated pressure compensation system for a Measurement-While-Drilling Tool of claim 1, further comprising:

a valve tip connected to the lower end of the pressure balance rod; and, the cross-sectional area of the cylinder bore portion of the pressure balance chassis being substantially equal to the sum of the cross-sectional area of the valve tip plus the cross-sectional area of the pressure balance rod.

3. An isolated pressure compensation system for a Measurement-While-Drilling Tool of claim 1, further comprising:

the motor-electronics chassis connected to the upper end of the actuator chassis;

a motor located inside the motor-electronics chassis;

a gear train attached to the motor and extending into the actuator chassis; and, wherein the gear train and motor are not exposed to the pressure compensating fluid.

4. An isolated pressure compensation system for a Measurement-While-Drilling Tool of claim 1, further comprising:

a hollow pressure barrel removably connectable over the pressure balance chassis and the actuator chassis; and the barrel having a plurality of venting perforations positioned in alignment with the bladder such that the bladder is exposed to drilling fluid external to the MWD Tool.

5. An isolated pressure compensation system for a Measurement-While-Drilling Tool of claim 1, further comprising:

the actuator chassis having a pair of diametrically opposing longitudinal slits, extending to the upper end of the actuator chassis;

a pair of threaded fastener holes intersecting each slit in perpendicular relation;

a threaded fastener located in each fastener hole;

a portal located internally of the fastener holes;

a cylindrical gear train housing for a motor;

the gear train housing being locatable in the portal; and, wherein tightening the fasteners in the fastener holes compresses the portal interior onto the gear train housing to secure the gear train housing in position.

6. An isolated pressure compensation system for a Measurement-While-Drilling Tool of claim 5, further comprising:

the gear train housing being made of a case-hardened material.

7. An isolated pressure compensation system for a Measurement-While-Drilling Tool of claim 5, further comprising:

the gear train housing having an outer diameter equal to or greater than the outer diameter of a motor to which it is attached.

8. An isolated pressure compensation system for a Measurement-While-Drilling Tool of claim 1, further comprising:

the motor-electronics chassis connected to the upper end of the actuator chassis;

a cylindrical gear train housing for a motor;

a motor attached to the gear train housing;

a rear plate attached to the motor;

electrical connectors attached to the motor extending through the rear plate; and, the motor locatable inside the motor-electronics chassis.

9. An actuator assembly for a Measurement-While-Drilling Tool, comprising:

a generally tubular actuator chassis;

a pair of diametrically opposing longitudinal slits, extending along the upper end of the actuator chassis;

a pair of threaded fastener holes intersecting each slit in perpendicular relation;

a threaded fastener located in each fastener hole;

a portal located internally of the fastener hole, the portal receivable of a cylindrical gear train housing for a motor;

a rotary motor attached to the gear train housing;

the gear train housing having an output shaft extending into the actuator chassis;

a thrust absorbing coupling attached on a first side to the output shaft;

a screw attached at one end to a second side of the coupling;

a ball screw connector slidably located inside the housing and attached to the opposite end of the screw;

a pin extending from the exterior of the ball screw connector, the pin located in the slot on the actuator chassis to prevent rotation of the ball screw relative to the housing;

a pressure balance rod attached to the ball screw connector, the pressure balance rod extending through an opening in the bottom end of the housing; and, wherein rotation of the rotary motor causes linear movement of the pressure balance rod relative to the actuator chassis.

10. A modular Measurement-While-Drilling Tool, comprising:

a lower pulser assembly receivable in a landing sub, the lower pulser having an orifice located at its upper end;

a screen housing connectable to an upper end of the lower pulser assembly, and having a plurality of passages through which drilling fluid enters the MWD Tool;

a pressure balance chassis removably connectable to an upper end of the screen housing;

an actuator chassis removably connectable to an upper end of the pressure balance chassis;

a motor-electronics chassis removably connectable to the upper end of the actuator chassis;

a hollow pressure barrel connectable over the motor-electronics chassis, actuator chassis, and pressure balance chassis, and removably connectable to the upper end of the screen housing;

a fluid-filled pressure compensating reservoir in axially sealed relationship within the pressure balance chassis;

a pliable bladder circumferentially surrounding the pressure compensating reservoir;

a pressure balance rod extending through the pressure balance chassis in slidable relation;

a piston formed on the pressure balance rod, the piston being axially slidable within a cylinder bore portion of the pressure balance chassis;

the compensating reservoir being in fluid communication with the cylinder bore above the piston;

a valve tip on a lower end of the pressure balance rod positioned for flow restricting alignment with the orifice of the lower pulser;

the pressure barrel having a plurality of venting perforations positioned in alignment with the bladder such that the bladder is exposed to drilling fluid external to the MWD Tool;

wherein drilling fluid pressure acting on the valve tip is substantially compensated by fluid pressure in the compensating reservoir acting on the piston; and, wherein upon disconnection of the motor-electronics chassis from the actuator chassis, the fluid in the compensating reservoir remains axially sealed within the pressure balance assembly.

* * * * *